US009488931B2

(12) United States Patent
Yasuda et al.

(10) Patent No.: US 9,488,931 B2
(45) Date of Patent: Nov. 8, 2016

(54) IMAGE FORMING APPARATUS

(71) Applicants: Makoto Yasuda, Kanagawa (JP); Jun Hitosugi, Tokyo (JP); Takamasa Ozeki, Kanagawa (JP); Mutsuki Morinaga, Kanagawa (JP); Emiko Shiraishi, Tokyo (JP); Wakana Itoh, Kanagawa (JP); Hitoshi Yamamoto, Kanagawa (JP); Takatsugu Komori, Chiba (JP); Kunio Hasegawa, Kanagawa (JP); Tadashi Kasai, Kanagawa (JP); Kazuaki Kamihara, Tokyo (JP); Kazumi Kobayashi, Tokyo (JP); Hiroyuki Kunii, Kanagawa (JP); Masaki Sukesako, Kanagawa (JP); Yuichi Aizawa, Kanagawa (JP); Masakazu Terao, Ishikawa (JP); Masayoshi Nakayama, Kanagawa (JP); Takuma Higa, Kanagawa (JP); Masahiro Katoh, Kanagawa (JP); Kohei Matsumoto, Tokyo (JP)

(72) Inventors: Makoto Yasuda, Kanagawa (JP); Jun Hitosugi, Tokyo (JP); Takamasa Ozeki, Kanagawa (JP); Mutsuki Morinaga, Kanagawa (JP); Emiko Shiraishi, Tokyo (JP); Wakana Itoh, Kanagawa (JP); Hitoshi Yamamoto, Kanagawa (JP); Takatsugu Komori, Chiba (JP); Kunio Hasegawa, Kanagawa (JP); Tadashi Kasai, Kanagawa (JP); Kazuaki Kamihara, Tokyo (JP); Kazumi Kobayashi, Tokyo (JP); Hiroyuki Kunii, Kanagawa (JP); Masaki Sukesako, Kanagawa (JP); Yuichi Aizawa, Kanagawa (JP); Masakazu Terao, Ishikawa (JP); Masayoshi Nakayama, Kanagawa (JP); Takuma Higa, Kanagawa (JP); Masahiro Katoh, Kanagawa (JP); Kohei Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/939,057

(22) Filed: Nov. 12, 2015

(65) Prior Publication Data

US 2016/0147174 A1 May 26, 2016

(30) Foreign Application Priority Data

Nov. 25, 2014 (JP) ..... 2014-237582

(51) Int. Cl.
*G03G 15/08* (2006.01)

(52) U.S. Cl.
CPC ..... *G03G 15/0824* (2013.01)

(58) Field of Classification Search
None
See application file for complete search history.

(56) References Cited

U.S. PATENT DOCUMENTS

| | | | | |
|---|---|---|---|---|
| 7,269,364 | B2 * | 9/2007 | Tanaka | G03G 15/556 399/257 |
| 2009/0003865 | A1 * | 1/2009 | Endou | G03G 15/0844 399/66 |
| 2012/0099878 | A1 | 4/2012 | Sukesako et al. | |
| 2012/0237250 | A1 | 9/2012 | Higa | |
| 2014/0093286 | A1 | 4/2014 | Itoh | |

(Continued)

FOREIGN PATENT DOCUMENTS

| | | |
|---|---|---|
| JP | 2008-233152 | 10/2008 |
| JP | 2008-268664 | 11/2008 |

(Continued)

*Primary Examiner* — Walter L Lindsay, Jr.
*Assistant Examiner* — Jas Sanghera
(74) *Attorney, Agent, or Firm* — Oblon, McClelland, Maier & Neustadt, L.L.P.

(57) ABSTRACT

An image forming apparatus includes a latent image bearer; a developing device containing two-component developer and including a developer bearer, a development voltage source, and a toner concentration detector; a toner supply device to supply toner to the developing device; a transfer device; and a controller to keep a toner concentration in the developer in the developing device at a target toner concentration during image formation. The controller executes forced toner consumption in which the developing device supplies the toner to the latent image bearer the toner at a predetermined forced toner consumption timing, while inhibiting the toner supply device from supplying toner. When the toner concentration falls to a prescribed toner density lower than the target toner concentration, the controller completes the forced toner consumption and executes a post-consumption toner supply operation.

10 Claims, 9 Drawing Sheets

(56) References Cited

U.S. PATENT DOCUMENTS

| | | | |
|---|---|---|---|
| 2014/0341597 | A1 | 11/2014 | Urayama et al. |
| 2015/0160599 | A1 | 6/2015 | Kamihara et al. |

FOREIGN PATENT DOCUMENTS

| | | | | |
|---|---|---|---|---|
| JP | 2010-091801 | | 4/2010 | |
| JP | 2010-091801 | A * | 4/2010 | ..... G03G 15/08 |

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-237582, filed on Nov. 25, 2014, in the Japan Patent Office, the entire disclosure of which is hereby incorporated by reference herein.

BACKGROUND

1. Technical Field

Embodiments of the present invention generally relate to an image forming apparatus, such as, a copier, a printer, a facsimile machine, a plotter, or a multifunction peripheral (MFP) including at least two of copying, printing, facsimile transmission, plotting, and scanning capabilities, and, more particularly, to an image forming apparatus that forms an image by developing a latent image with developer including toner and carrier and transferring the image to a recording medium.

2. Description of the Related Art

There are image forming apparatuses that form images by developing latent images with developer including toner and carrier and transferring the images to sheets of recording media. Among them, there are image forming apparatuses that forcibly consume toner in developer stored in a developing device. For example, to consume toner, the toner is caused to adhere to a non-image area of a latent image bearer.

SUMMARY

An embodiment of the present invention provides an image forming apparatus that includes at least one latent image bearer, at least one developing device to contain developer including toner and carrier, a toner supply device to supply toner to the developing device, a transfer device to transfer a toner image formed, by the developing device, on the latent image bearer, onto a recording medium, and a controller.

The developing device includes a developer bearer to supply the developer to a developing range facing the latent image bearer, a development voltage source to apply a development voltage to the developer bearer to form a developing electrical field in the developing range to cause the toner to adhere to the latent image, thereby forming a toner image, and a toner concentration detector to detect a concentration of toner in developer in the developing device.

The controller causes, based on a detected toner concentration detected by the toner concentration detector, the toner supply device to keep the toner concentration at a target toner concentration during image formation. The controller executes forced toner consumption in which the developing device supplies the toner to the latent image bearer to forcibly consume the toner at a predetermined forced toner consumption timing. The controller starts the forced toner consumption while inhibiting the toner supply device from supplying toner and completes the forced toner consumption when the detected toner concentration falls to a prescribed toner density lower than the target toner concentration. Subsequent to the forced toner consumption, the controller executes a post-consumption toner supply operation in which the toner supply device supplies toner to the developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
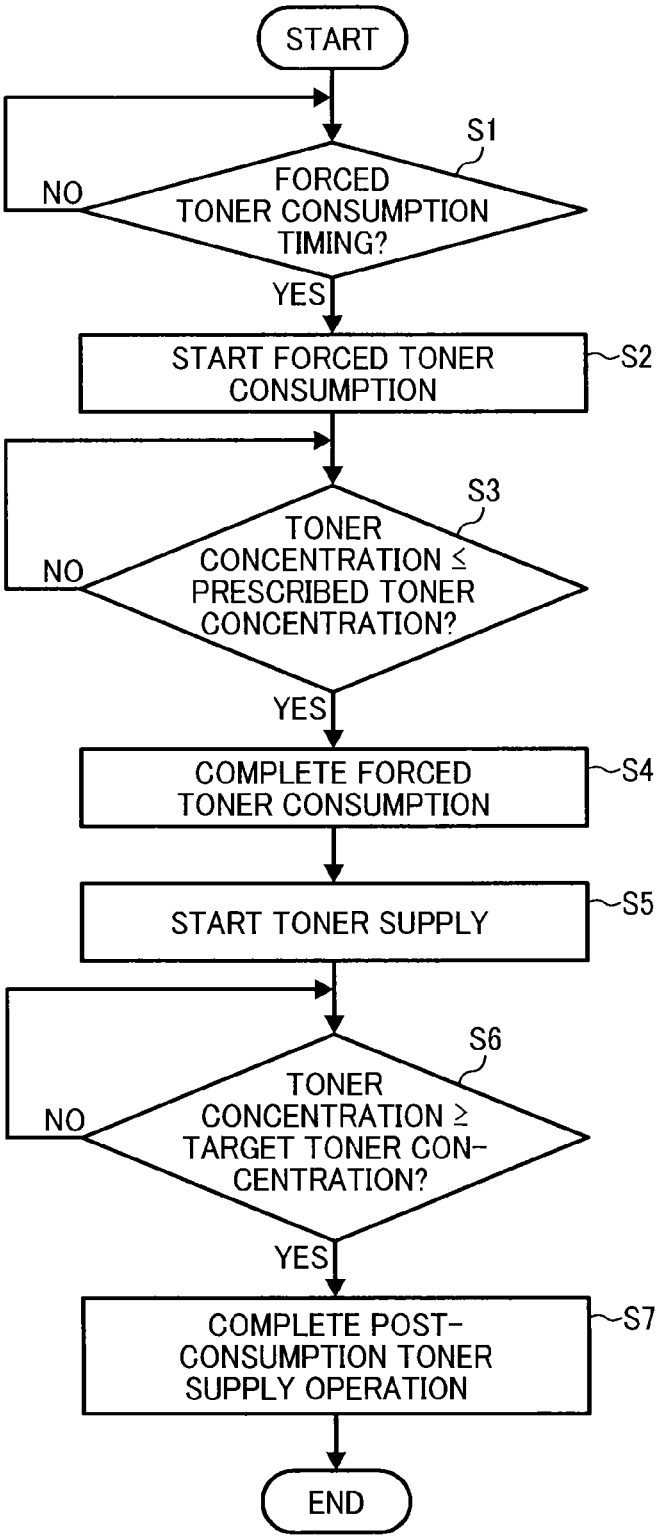
FIG. 1 is a flowchart of forced toner consumption and a subsequent toner supply operation according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
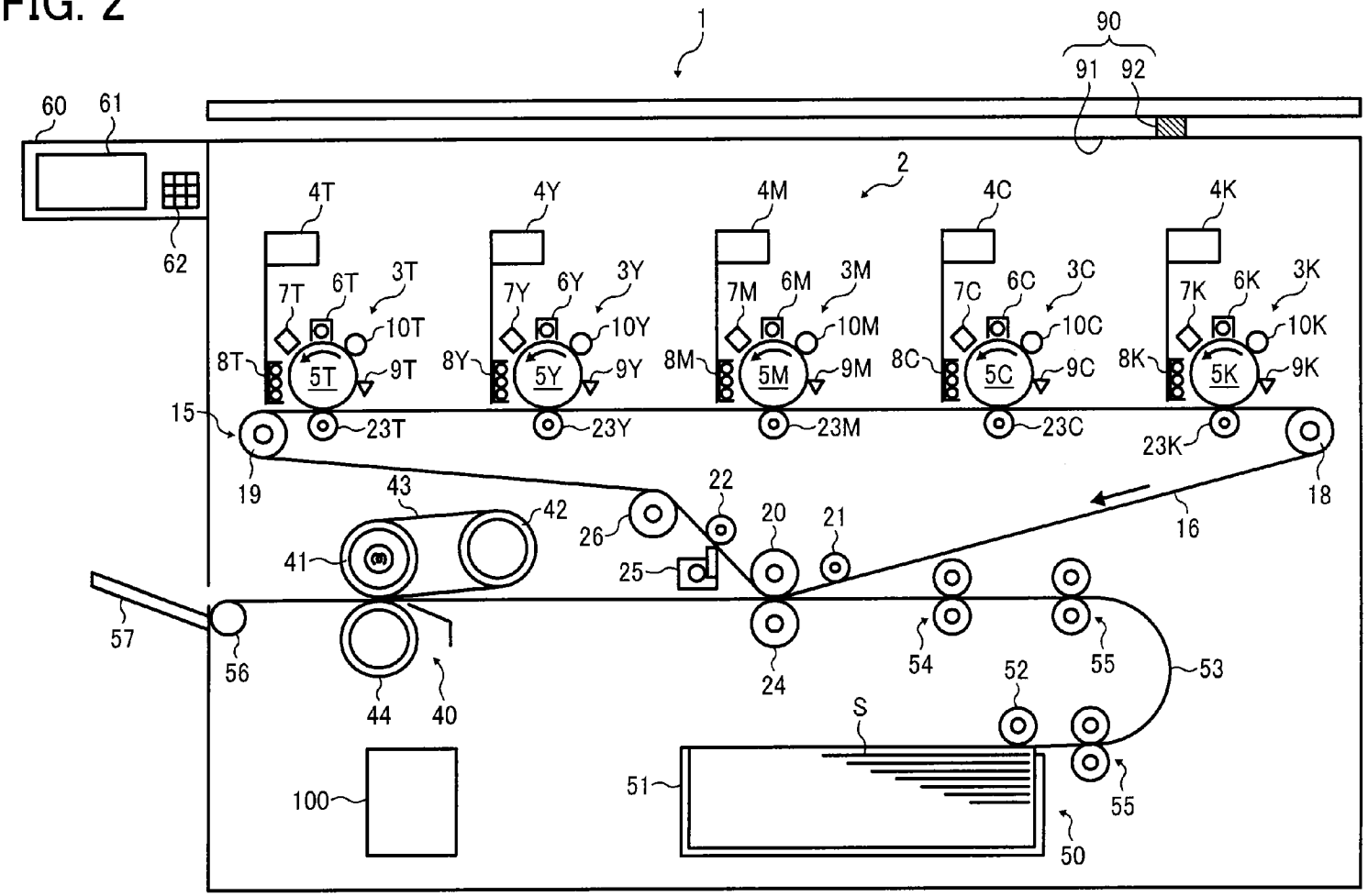
FIG. 2 is a schematic diagram of an image forming apparatus according to an embodiment.
Figure 3:
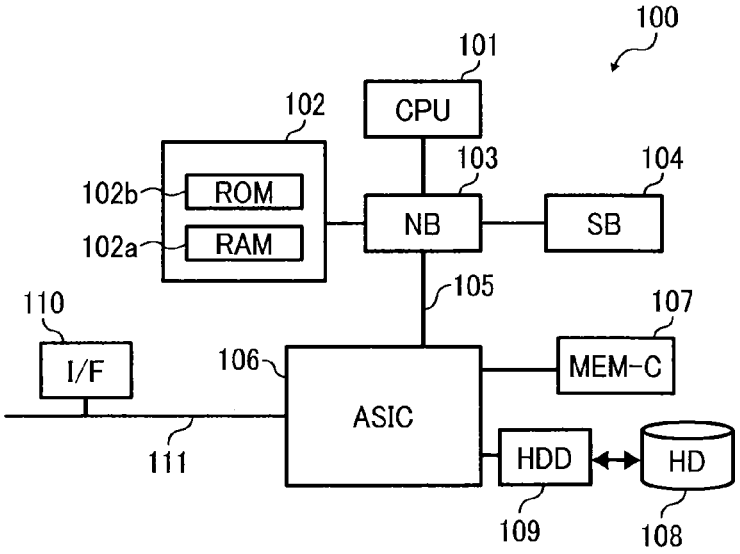
FIG. 3 is a block diagram illustrating electrical circuitry of a controller of the image forming apparatus illustrated in FIG. 2.

Referring now to the drawings, wherein like reference numerals designate identical or corresponding parts throughout the several views thereof, and particularly to FIGS. 2 and 3, a multicolor image forming apparatus according to an embodiment of the present invention is described.

FIG. 2 is a schematic diagram of an image forming apparatus 1 according to the present embodiment. For example, the image forming apparatus 1 is a printer.

The image forming apparatus 1 includes a controller 100, a scanner 90, an image forming section 2, a sheet feeder 50, a fixing device 40, a control panel 60, and a transfer unit 15.

As illustrated in FIG. 3, the controller 100 includes a central processing unit (CPU) 101, a main memory (MEM-P) 102, a north bridge (NB) 103, and a south bridge (SB) 104. The controller 100 further includes an accelerated graphics port (AGP) bus 105, an application specific integrated circuit (ASIC) 106, and a local memory (MEM-C) 107. The controller 100 further includes a hard disk (HD) 108 serving as a memory device, a hard disk drive (HDD) 109, and a network interface (I/F) 110.

The CPU 101 processes data, executes computation, and controls the scanner 90, the image forming section 2, the sheet feeder 50, the fixing device 40, and the transfer unit 15, according to a program stored in the main memory 102. The main memory 102 serves as a memory area for the controller 100 and includes a read only memory (ROM) 102*b* and random access memory (RAM) 102*a*.

The ROM 102*b* stores programs and data to implement the functions of the controller 100. Alternatively, the program stored in the ROM 102*b* can be recorded on computer-readable recording media such as a compact disc read only memory (CD-ROM), a floppy disk (FD), a compact disc-recordable (CD-R), a digital versatile disc (DVD) in the file form installable into or executable by the controller 100.

The RAM 102*a* is used for expansion of programs and data and as a drawing memory. The NB 103 serves as a bridge connecting the CPU 101 to the main memory 102, the SB 104, and the AGP bus 105. The SB 104 serves as a bridge between the NB 103 and peripheral devices. The AGP bus 105 is a bus interface for graphics accelerator cards to accelerate graphics processing.

The ASIC 106 executes rotation of image data or the like using a memory controller to control a peripheral component interconnect (PCI) target, an AGP master, an arbiter (ARB) serving as a core of the ASIC 106, and the local memory 107, and hardware logic. The ASIC 106 is constituted of multiple direct memory access controllers (DMACs). The ASIC 106 is connected via a PCI bus 111 to a universal serial bus interface and further connected to an interface of electrical and electronics engineers (IEEE) 1394.

The local memory 107 is used as a buffer for images to be copied or codes. The HD 108 stores image data, font data used in printing, and forms. The HDD 109 controls data retrieval from and data writing in the HD 108, controlled by the CPU 101. The network interface 110 transmits data to and from external devices such as data processing devices via a communication network.

The scanner 90 optically scans an image of a document to generate image data. Specifically, the scanner 90 emits light to the document and receives light reflected from the document with a reading sensor 92 such as a charge-coupled device (CCD) or a contact image sensor (CIS). It is to be noted that the term "image data" used here is data describing an image to be formed on a recording medium such as paper sheet, using electrical color separation image signals indicative of red (R), green (G), and blue (B). The scanner 90 includes an exposure glass 91 and the reading sensor 92. Documents to be scanned are placed on the exposure glass 91. The reading sensor 92 reads image data of the document on the exposure glass 91.

The image forming section 2 forms images according to the image data acquired by the scanner 90 or image data received via the network interface 110. The image forming section 2 includes five image forming units 3T, 3Y, 3M, 3C, and 3K.

Reference characters T, Y, M, C, and K represent transparent, yellow, magenta, cyan, and black, respectively.

The image forming units 3T, 3Y, 3M, 3C, and 3K form images using developers respectively including transparent toner, yellow toner, magenta toner, cyan toner, and black toner. It is to be noted that, hereinafter yellow, magenta, cyan, and black toners are collectively referred to as colored toners (i.e., primary color toners).

Specifically, the color toner is powder including resin particles having electrostatic (triboelectric) chargeability, in which a colorant such as pigment or dye is mixed. By contrast, the transparent toner (i.e., clear toner) is colorless toner and enhances gloss level of a colored toner image on the recording sheet when applied on the colored toner image. When applied to a spotless surface of the recording sheet, the transparent toner enhances gloss level of the recording sheet. The transparent toner is produced by adding, for example, silicon dioxide ($SiO_2$) or titanium dioxide ($TiO_2$) to polyester resin having low molecular weight.

It is to be noted that the transparent toner can contain a colorant provided that the amount added is small so that the colorant does not hinder the visibility of the colored toner image.

The five image forming units 3T, 3Y, 3M, 3C, and 3K are similar in configuration except the color of toner used therein, and the operations thereof are described using the image forming unit 3Y as a representative. It is to be noted that, when color discrimination is not necessary, one of the image forming unit 3T, 3Y, 3M, 3C, and 3K is simply referred to as the image forming unit 3.

The image forming unit 3Y includes a toner supply device 4Y, a drum-shaped photoconductor 5Y serving as a latent image bearer, a charging device 6Y, an optical writing device 7Y, a developing device 8Y, a discharge lamp 9Y, and a cleaning device 10Y. The toner supply device 4Y contains yellow toner and supplies the yellow toner to the developing device 8Y. As a conveying screw disposed in the toner supply device 4Y rotates, the yellow toner contained in the toner supply device 4Y is supplied to the developing device 8Y, and the amount of yellow toner supplied corresponds to the amount of rotation of the conveying screw.

Figure 11:
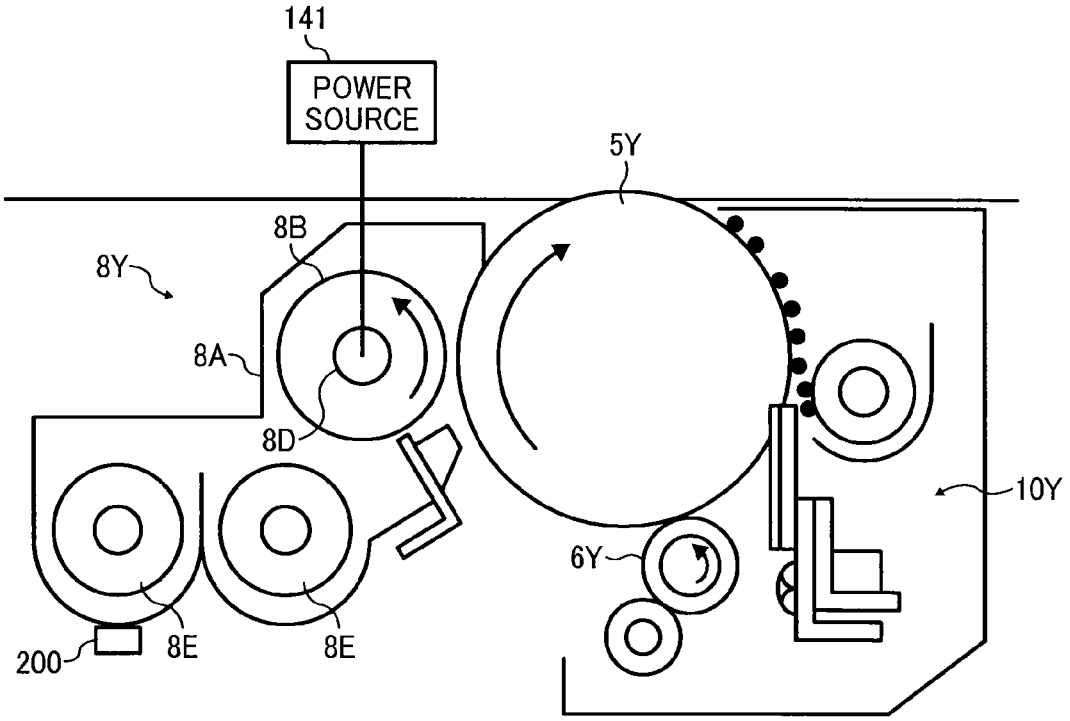
FIG. 11 is a schematic cross-sectional view of a developing device according to an embodiment.

Referring to FIG. 11, the developing device 8Y includes a toner concentration sensor 200, such as a magnetic permeability sensor, to detect the concentration of toner in the developing device 8Y or the percentage of toner in developer contained in the developing device 8Y. The magnetic permeability sensor transmits detection results as toner concentration signals to the controller 100. According to the toner concentration signals, the controller 100 recognizes the toner concentration in developer in the developing device 8Y. When the detection result is lower than a target value, the controller 100 rotates the conveying screw corresponding to the difference between the detection result and the target value, thereby supplying the yellow toner to the developing device 8Y.

The photoconductor 5Y rotates counterclockwise in FIG. 2, and the charging device 6Y applies a charging bias thereto so that the surface of the photoconductor 5Y is uniformly charged to a potential similar to the charging bias. The optical writing device 7Y includes a light-emitting diode (LED) array and the like and illuminates the surface of the photoconductor 5Y according to yellow image data transmitted from the controller 100. Of the uniformly charged surface of the photoconductor 5Y, an illuminated portion is substantially reduced in potential. Thus, an electrostatic latent image for yellow is formed on the surface of the photoconductor 5Y. The developing device 8Y contains developer including yellow toner and magnetic carrier and causes the yellow toner to selectively adhere to the electrostatic latent image, thereby forming a yellow toner image on the photoconductor 5Y.

Referring to FIG. 11, the developing device 8Y according to the present embodiment includes a casing 8A to contain the developer including yellow toner and magnetic carrier. The developer contained in the casing 8A is carried on a developing roller 8B serving as a developer bearer and transported to a developing range facing the photoconductor 5Y. The developing roller 8B includes a stationary magnet roller 8D, serving as a magnetic field generator, disposed inside a hollow developing sleeve. With effects of magnetic force exerted by the magnet roller 8D, the magnetic carrier is attracted to the outer circumferential face of the developing sleeve, and developer is borne on the outer circumferential face of the developing sleeve. The developer is transported as the developing sleeve rotates.

The developing device 8Y further includes conveying screws 8E to transport and the developer in the casing 8A while agitating the developer.

A power source 141 serving as a development voltage source applies a developing bias to the developing sleeve. Then, a developing electric field is generated between the developing sleeve and the electrostatic latent image on the photoconductor 5Y for electrostatically conveying toner, which is charged in a normal charging polarity, from the developing sleeve to the photoconductor 5Y. The developing electrical field causes yellow toner to selectively adhere to the electrostatic latent image, thereby forming a yellow toner on the photoconductor 5Y.

The yellow toner image is primarily transferred onto the surface of an intermediate transfer belt 16 described later. After the yellow toner image is primarily transferred onto the intermediate transfer belt 16, the discharge lamp 9Y removes electricity from the surface of the photoconductor 5Y, and the cleaning device 10Y removes residual toner remaining on the surface of the photoconductor 5Y.

The sheet feeder 50 includes a sheet tray 51, a sheet feeding roller 52, a feeding path 53, a registration roller pair 54, and multiple conveyance roller pairs 55. The sheet feeder 50 transports recording sheets S (recording media sheets) to a secondary transfer nip described later. The sheet feeding roller 52 feeds, by rotation, the recording sheet S from the sheet tray 51 to the feeding path 53. While sequentially nipped by the multiple conveyance roller pairs, the recording sheet S is transported to an end of the feeding path 53. The sheet P is nipped in the registration roller pair 54, and skew of the recording sheet S is corrected. Then, the registration roller pair 54 rotates to forward the sheet P to the secondary transfer nip between the intermediate transfer belt 16 and a backup roller 24 facing a secondary transfer roller 20.

Although the description above concerns the image forming unit 3Y, in image forming unit 3T, 3M, 3C, and 3K as well, transparent, magenta, cyan, and black toner images are formed on the photoconductors 5T, 5M, 5C, and 5K, respectively, and primarily transferred onto the intermediate transfer belt 16 in similar manners.

Between the image forming units 3T, 3Y, 3M, 3C, and 3K and the sheet feeder 50 in a vertical direction in FIG. 2, the transfer unit 15 is disposed. The transfer unit 15 rotates the intermediate transfer belt 16, which is an endless belt entrained multiple rollers into a loop, clockwise in FIG. 2. Primary transfer rollers 23T, 23Y, 23M, 23C, and 23K are disposed inside the loop formed by the intermediate transfer belt 16, and the intermediate transfer belt 16 is interposed between the primary transfer rollers 23T, 23Y, 23M, 23C, and 23K and the photoconductors 5T, 5Y, 5M, 5C, and 5K. The portions where the photoconductors 5T, 5Y, 5M, 5C, and 5K are in contact with the outer circumferential face of the intermediate transfer belt 16 are called primary transfer nips.

Additionally, a driving roller 18, a driven roller 19, the secondary transfer roller 20, and rollers 21 and 22 are disposed inside the loop formed by the intermediate transfer belt 16. Additionally, the backup roller 24 forming the secondary transfer nip, a belt cleaner 25, and a tension roller 26 are disposed on the outer side of the loop of the intermediate transfer belt 16. The tension roller 26 makes the intermediate transfer belt 16 taut.

As the driving roller 18 rotates clockwise in FIG. 2, the intermediate transfer belt 16 rotates counterclockwise in FIG. 2. Each of the primary transfer rollers 23T, 23Y, 23M, 23C, and 23K receives a primary transfer bias from a power supply for image transfer. Thus, a primary transfer electrical field is generated in the primary transfer nip. The transparent, yellow, magenta, cyan, and black toner images are primarily transferred from the photoconductors 5T, 5Y, 5M, 5C, and 5K to the intermediate transfer belt 16 by the transfer electric field and the nip pressure.

While the rotating intermediate transfer belt 16 sequentially passes through the five primary transfer nips, the transparent, yellow, magenta, cyan, and black toner images are superimposed one another on the outer circumferential face of the intermediate transfer belt 16. As the intermediate transfer belt 16 rotates, the superimposed toner images enter the secondary transfer nip bestrewn the intermediate transfer belt 16 and the backup roller 24. A power supply for image transfer applies a secondary transfer bias to the secondary transfer roller 20, which presses the intermediate transfer belt 16 against the backup roller 24. Thus, a secondary transfer electrical field is generated in the secondary transfer nip.

The registration roller pair 54 forwards the recording sheet S so that the recording sheet S coincides with the superimposed toner images on the intermediate transfer belt 16 in the secondary transfer nip. In the secondary transfer nip, the superimposed toner images are transferred secondarily from the intermediate transfer belt 16 onto the recording sheet S by the secondary transfer electrical field and nip pressure. Thus, a multicolor toner image (i.e., a full-color image) is formed on the recording sheet S.

After passing through the secondary transfer nip, the recording sheet S is conveyed to the fixing device 40. The belt cleaner 25 removes toner remaining on the outer circumferential face of the intermediate transfer belt 16 downstream from the secondary transfer nip before the intermediate transfer belt 16 enters the primary transfer nip for transparent toner.

The fixing device 40 includes a heating roller 41, a tension roller 42, an endless fixing belt 43, and a pressure roller 44. In a state entrained around the heating roller 41 and the tension roller 42 disposed inside a loop of the fixing belt 43, the fixing belt 43 rotates clockwise in FIG. 2 as the heating roller 41 rotates. The pressure roller 44 presses the fixing belt 43 against the heating roller 41, and a contact portion therebetween is called a fixing nip. In the fixing device 40, the sheet is nipped in the fixing nip and heated by the heating roller 41 via the fixing belt 43. With the heat and nip pressure, the multicolor toner image is fixed on the recording sheet S.

Downstream from the fixing device 40, the recording sheet S is ejected outside the apparatus by an ejection roller 56 and stacked on a stack tray 57.

The control panel 60 serving as an input accepting unit includes a panel display 61 and a keypad 62. The panel display 61 includes an image display and displays various types of information and images. The panel display 61 accepts instructions from users operating (touching) the panel display 61. The keypad 62 includes numeric keys and multiple keys including a start key to accept instruction to start copying. The instructions and data accepted by the control panel 60 are transmitted to the controller 100.

In the present embodiment, the controller 100 performs image density adjustment, and the image density adjustment involves formation of a predetermined image pattern (constructed of toner patches) on the image bearer, such as the intermediate transfer belt 16 and the photoconductor 5.

Specifically, the predetermined image pattern is formed in an area from which toner is not transferred onto the recording sheet S (hereinafter "non-image area"), such as a sheet interval area (between an image on a first sheet S and an image on a second sheet S) in successive image formation. The image density of the image patches is detected using an image density sensor, such as a reflective-type optical sensor. When the detected image density is out of a target image density, the controller 100 changes the target toner concentration of the developer in the developing device 8 within a predetermined tolerable toner concentration range.

For example, the tolerable toner concentration range is such a range that, if the toner concentration is out of that range, there is the possibility of occurrence of inconveniences unsolvable by changing other image formation parameters (i.e., the charging bias, the developing bias, and exposure). In the present embodiment, a lower limit of the tolerable toner concentration range is such a value that adhesion of carrier is not solved by adjusting other image formation parameters if the toner concentration falls below the lower limit. For example, the RAM 102*a* or the ROM 102*b* stores the predetermined tolerable toner concentration range.

Next, descriptions are given below of forced toner consumption.

In the present embodiment, the image forming apparatus 1 performs the forced toner consumption to discharge degraded toner from the developing device 8. Generally, image formation is not feasible during the forced toner consumption, and it is preferred to reduce the duration of forced toner consumption. To reduce the duration of forced toner consumption, degraded toner in the developing device is preferably consumed promptly. Further, if toner is forcibly discharged from the developing device 8 to the latent image bearer while supplying fresh toner to the developing device 8, the fresh toner is inevitably is consumed in the forced toner consumption. Thus, the efficiency in consuming degraded toner is not sufficient.

FIG. 1 is a flowchart of the forced toner consumption and a post-consumption toner supply operation according to the present embodiment.

Referring to FIG. 1, at a predetermined forced toner consumption timing (Yes at S1), at S2, the controller 100 starts the forced toner consumption. For example, the predetermined forced toner consumption timing includes the occurrence of a predetermined event, such as power-on of the image forming apparatus 1, image quality adjustment (process control), or acceptance of forced toner consumption instruction by the control panel 60, that triggers forced toner consumption.

It is to be noted that, although the forced toner consumption according to the present embodiment involves forcibly consuming toner contained in the developing devices 8Y, 8M, 8C, and 8K of the image forming units 3Y, 3M, 3C, and 3K other than the image forming unit 3T, alternatively, toner contained in the developing device 8T can be forcibly consumed as well. Yet alternatively, the number of image forming units 3 subjected to the forced toner consumption can be three or smaller.

When the forced toner consumption is started at S2, the controller 100 causes the optical writing devices 7Y, 7M, 7C, and 7K to form, on each of the photoconductors 5Y, 5M, 5C, and 5K, a predetermined electrostatic latent pattern for consuming toner while inhibiting toner supply operation. The controller 100 causes the developing devices 8Y, 8M, 8C, and 8K to discharge toner therefrom to the photoconductors 5Y, 5M, 5C, and 5K to develop the electrostatic latent pattern, thereby forcibly consuming toner. The toner adhering to the electrostatic latent pattern (toner pattern) is primarily transferred onto the intermediate transfer belt 16 and collected by the belt cleaner 25. It is to be noted that, alternatively, the toner forming the toner pattern can be collected by the cleaning device 10 of each image forming unit 3 without transferring the toner pattern onto the intermediate transfer belt 16.

The amount of toner consumed forcibly is adjustable with the area or type of the electrostatic latent pattern for consuming toner, for example. The toner pattern for consuming toner can be a solid image or a halftone image (dot image), and the amount of toner consumed forcibly is adjustable by changing the length of toner pattern in the sub-scanning direction. When the toner pattern is a solid image that occupies an entire image area on the photoconductor 5, a greater amount of toner is consumed in a shorter time, thereby efficiently discharging degraded toner. However, there is a risk that the amount of toner exceeds a capacity of the belt cleaner 25 to remove the toner pattern, resulting in defective cleaning.

By contrast, when the toner pattern for consuming toner is a halftone image, the risk of the occurrence of defective cleaning is small. However, the amount of toner consumed per unit time is small, and the duration of forced toner consumption becomes longer.

In view of the foregoing, in the present embodiment, while inhibiting defective cleaning, the duration of forced toner consumption is reduced as follows.

Figure 4:
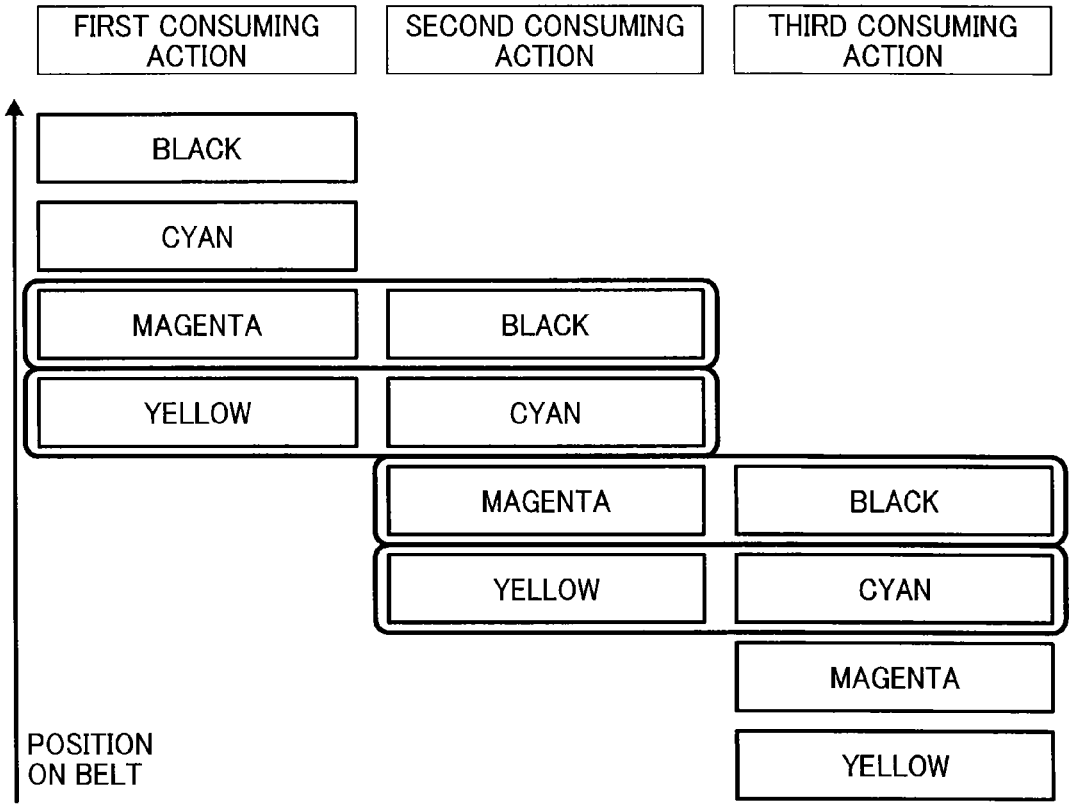
FIG. 4 is a diagram illustrating relative positions of toner patterns transferred at a time to an intermediate transfer belt in the forced toner consumption illustrated in FIG. 1.

FIG. 4 is a diagram illustrating the relative positions of toner patterns transferred at a time to the intermediate transfer belt 16 in the forced toner consumption according to the present embodiment.

To shorten the duration to the end of forced toner consumption in all of the image forming units 3Y, 3M, 3C, and 3K, it is preferred that the forced toner consumption start simultaneously in the multiple image forming units 3Y, 3M, 3C, and 3K. Additionally, by forming the electrostatic latent pattern for consuming toner having a length in the main scanning direction corresponding to the necessary consumption in the image forming units 3Y, 3M, 3C, and 3K, the duration to the end of forced toner consumption in all of the image forming units 3Y, 3M, 3C, and 3K can be shorter.

In this case, however, the toner patterns are sequentially superimposed on the toner pattern that has been primarily transferred onto the intermediate transfer belt 16 on the upstream side in the direction of rotation of the intermediate transfer belt 16. The number of toner patterns superimposed one on another is four at the most. Even if the toner patterns are halftone images, there is a risk that the four toner patterns superimposed one on another result in defective cleaning.

Therefore, in the forced toner consumption according to the present embodiment, as a unit consuming action, the electrostatic latent patterns having a predetermined length in the main scanning direction is formed to consume toner, and the consuming action is repeated until the necessary amount of toner is consumed. FIG. 4 illustrates electrostatic latent patterns formed in first, second, and third consuming actions from the left.

The length in the main scanning direction of the electrostatic latent pattern for consuming toner, formed in one consuming action, is set such that the toner patterns do not overlap with each other in a case where the consuming action is started simultaneously in the image forming units 3Y, 3M, 3C, and 3K and the toner patterns are primarily transferred onto the intermediate transfer belt 16. This action reduces the risk of the occurrence of defective cleaning.

However, the duration to the end of forced toner consumption in all of the image forming units 3Y, 3M, 3C, and 3K becomes longer if the consuming action is repeated so that the toner patterns of successive consuming actions do not overlap with each other.

Therefore, in the present embodiment, toner pattern formation timing is adjusted such that, as illustrated in FIG. 4, two toner patterns (magenta and yellow toner patterns) positioned on the back side in the main scanning direction and formed in a current consuming action overlap with two toner patterns (cyan and black toner patterns) positioned on the front side in the main scanning direction and formed in a subsequent consuming action.

With such adjustment, even if the above-described consuming action is repeated, the number of toner patterns overlap with each other is two at the most, thereby reducing the risk of the occurrence of defective cleaning. Further, the duration to the end of forced toner consumption in all of the image forming units 3Y, 3M, 3C, and 3K can be shorter compared with the case where the toner pattern formation timing is adjusted to prevent the toner patterns of the successive consuming actions from overlapping with each other.

Figure 5:
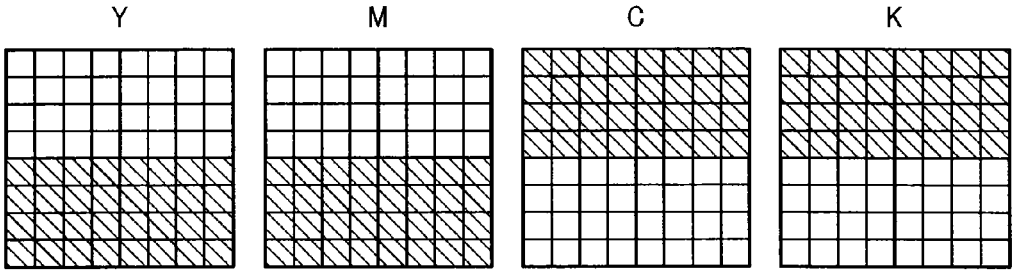
FIG. 5 illustrates unit patterns of an electrostatic latent pattern used in the forced toner consumption.

FIG. 5 illustrates respective unit patterns of yellow (Y), magenta (M), cyan (C), and black (K) electrostatic latent patterns used in the forced toner consumption.

To further reduce the risk of the occurrence of defective cleaning, halftone images having unit patterns illustrated in FIG. 5 are adopted as the electrostatic latent patterns for consuming toner, formed in the image forming units 3Y, 3M, 3C, and 3K, respectively. Accordingly, in the two overlapping toner patterns, namely, the magenta toner pattern and the black toner pattern, and the yellow toner pattern and the cyan toner pattern, the position to which toner adheres does not coincide with each other. Thus, the amount of toner input to the belt cleaner 25 at a time is reduced, thereby inhibiting the occurrence of defective cleaning.

In the present embodiment, since the forced toner consumption is executed in a state in which the toner supply operation is stopped, the toner concentration (e.g., percentage of toner) in developer in each of the developing devices 8Y, 8M, 8C, and 8K decreases as the consuming action is repeated. If the toner concentration is too low, there arises the possibility of adhesion of carrier, to the photoreceptor as described above. Accordingly, in the present embodiment, at S3 in FIG. 1, the controller 100 checks whether the toner concentration detected by the toner concentration sensor 200 is at or below the prescribed toner concentration. When the toner concentration detected by the toner concentration sensor 200 falls to or below the prescribed toner concentration (Yes at S3), the controller 100 does not execute the subsequent consuming action and completes the forced toner consumption at S4.

The prescribed toner concentration is set in a range not to cause adhesion of carrier. Specifically, in the present embodiment, the prescribed toner concentration is set to the lower limit of tolerable range of the target toner concentration during image formation. More specifically, as described above, the lower limit of the tolerable toner concentration range in the present embodiment is such a value that, if the toner concentration falls below the lower limit, adhesion of carrier particles is not solved by adjusting other image formation parameters. Accordingly, by setting the prescribed toner concentration to an identical value as the lower limit of tolerable range of the target toner concentration, the forced toner consumption is completed before the toner concentration decreases to a degree that it becomes difficult to resolve adhesion of carrier.

After the forced toner consumption is thus completed, at S5, the controller 100 causes the toner supply devices 4Y, 4M, 4C, and 4K to start the post-consumption toner supply operation to supply toner to the developing devices 8Y, 8M, 8C, and 8K to recover the toner concentration therein to the target toner concentration.

Specifically, at S6, the controller 100 checks whether the toner concentration detected by the toner concentration sensor 200 is equal to or greater than the target toner concentration. The controller 100 causes the toner supply devices 4Y, 4M, 4C, and 4K to continue the post-consumption toner supply operation until the toner concentration detected by the toner concentration sensor 200 becomes equal to or greater than the target toner concentration (Yes at S6). When the toner concentration is thus increased, at S7, the controller 100 completes the post-consumption toner supply operation.

It is to be noted that, after the forced toner consumption and the post-consumption toner supply operation subsequent thereto are completed, preferably the controller 100 executes the typical image quality adjustment (process control) to adjust the various types of image formation parameters (e.g., the charging bias, the developing bias, and the exposure) to attain a desired image quality.

In the present embodiment, although values of image formation parameters during the forced toner consumption are identical to values of those parameters during image formation, it is not necessary that the values during the forced toner consumption are identical to the values of those parameters during image formation. For example, the developing bias, the charging bias, and the exposure during the forced toner consumption can be set to make the developing potential during the forced toner consumption greater than the developing potential for image formation. As the developing potential increases, the amount per unit area of toner adhering to the electrostatic latent pattern for consuming toner increases, and accordingly toner in the developing device 8 can be consumed earlier. Thus, the duration of forced toner consumption can be shortened. It is to be noted that, in a case where the toner concentration that causes adhesion of carrier changes depending on the magnitude of developing potential, the prescribed toner concentration is adjusted according to the magnitude of developing potential during the forced toner consumption.

(Variation 1)

Next, descriptions are given below of Variation 1 of the forced toner consumption and the toner supply operation subsequent thereto, described above.

In the above-described embodiment, since the prescribed toner concentration is set to the lower limit of the tolerable toner concentration range considering the occurrence of adhesion of carrier, the forced toner consumption completes at a time point when the toner concentration falls to the lower limit of the tolerable toner concentration range. When the toner concentration is at the lower limit of the tolerable toner concentration range, the amount of toner remaining in the developing device 8 is relatively large, and it is preferred to further consume toner from the developing device 8.

Figure 6A:
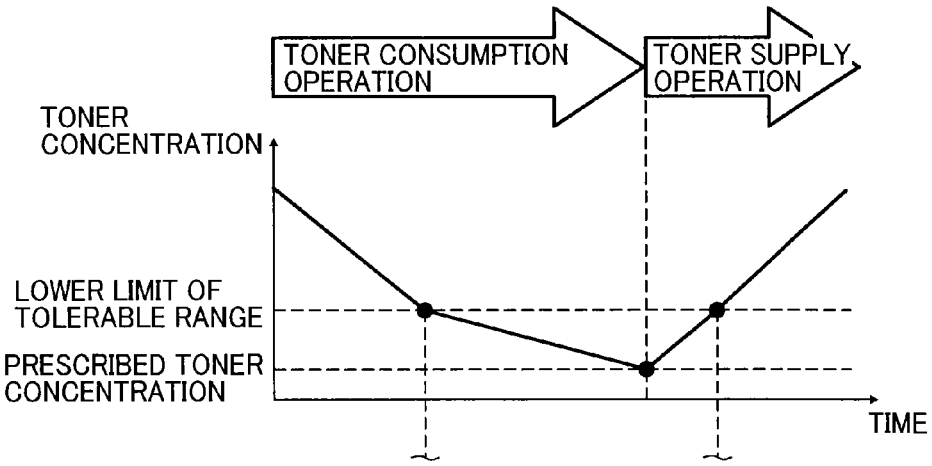
FIG. 6A is a schematic chart illustrating changes in toner concentration in developer during forced toner consumption and a subsequent toner supply operation according to Variation 1.

FIG. 6A is a schematic graph of changes in toner concentration in developer during the forced toner consumption and the post-consumption toner supply operation according to Variation 1.

Figure 6B:
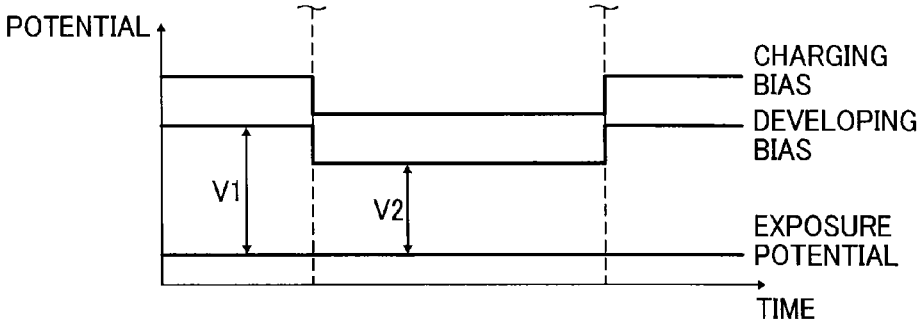
FIG. 6B is a schematic graph of changes in developing potential during the forced toner consumption and the subsequent toner supply operation according to Variation 1.

FIG. 6B is a schematic graph of changes in developing potential during the forced toner consumption and the post-consumption toner supply operation according to Variation 1.

In Variation 1, as illustrated in FIG. 6A, the prescribed toner concentration is lower than the lower limit of the tolerable toner concentration range. As illustrated in FIG. 6B, until the toner concentration falls to the lower limit, the developing potential is set at V1. When the toner concentration falls to the lower limit, the developing potential is reduced to V2, and, in this state, the forced toner consumption (indicated as "toner consumption operation" in FIG. 6A) is continued further until the toner concentration falls to the prescribed toner concentration. After then, the post-consumption toner supply operation (indicated as "toner supply operation" in FIG. 6A) is started.

This is advantageous in that the mount of toner discharged from the developing device 8 is greater compared with the above-described embodiment. The risk of adhesion of carrier starts to increase when the toner concentration in the developing device 8 is around the lower limit of the tolerable toner concentration range. In view of the foregoing, the adhesion of carrier is inhibited as follows in Variation 1.

Figure 7:
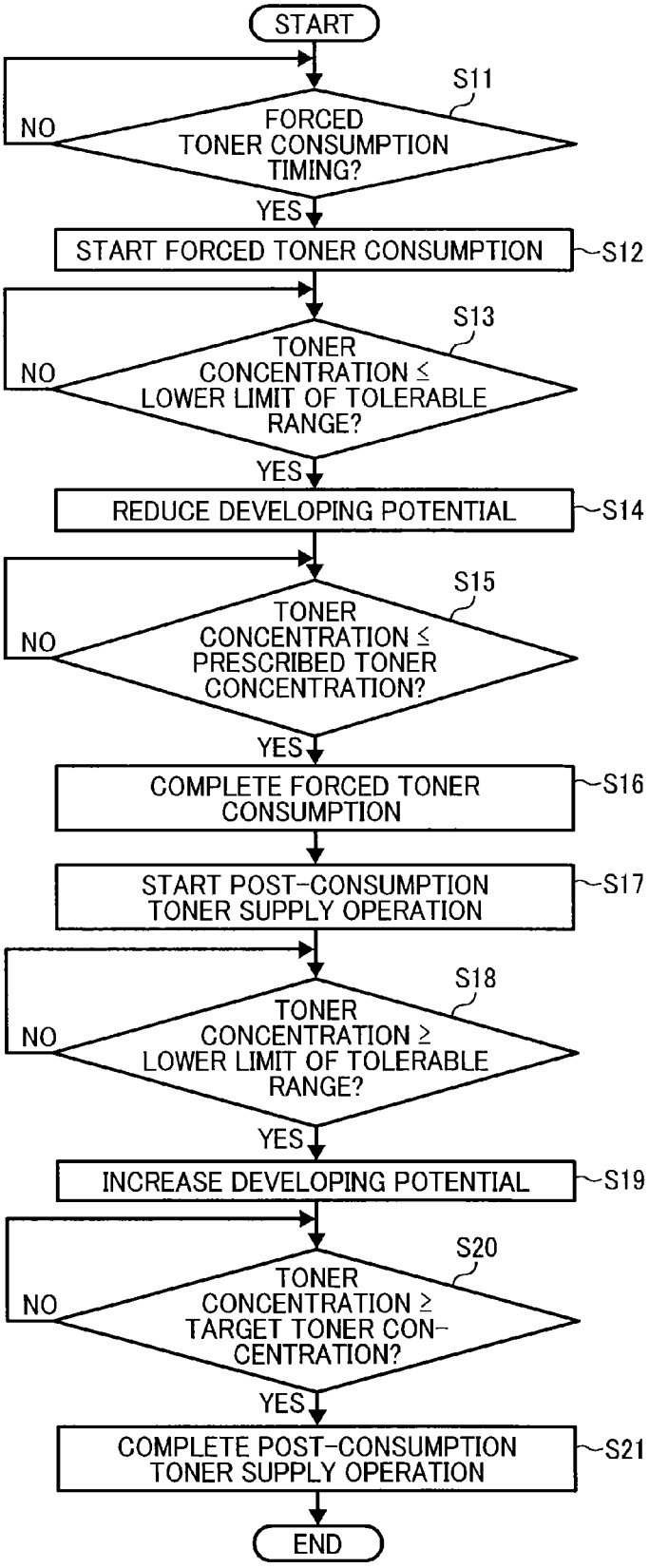
FIG. 7 is a flowchart of the forced toner consumption and the subsequent toner supply operation according to Variation 1.

FIG. 7 is a flowchart of the forced toner consumption and the subsequent toner supply according to Variation 1.

In Variation 1, similarly, at the predetermined forced toner consumption timing, namely, the occurrence of the event to trigger the forced toner consumption, (Yes at S11), at S2 the controller 100 starts the forced toner consumption. Subsequently, when the toner concentration detected by the toner concentration sensor 200 falls to or below the lower limit of the tolerable toner concentration range (Yes at S13), at S14 the controller 100 reduces the developing bias in absolute value to reduce the developing potential. It is to be noted that, in Variation 1, the charging bias is reduced in absolute value in accordance with the reduction in absolute value of the developing bias.

In this control operation, since the possibility of the occurrence of adhesion of carrier is small while the toner concentration in the developing device 8 is greater than the lower limit of the tolerable toner concentration range, the electrostatic latent pattern for consuming toner is developed with the developing potential set to V1, which is equal to or greater in strength than the developing potential for image formation. Accordingly, the amount per unit area of toner adhering to the electrostatic latent pattern is greater, and thus the toner in the developing device 8 can be consumed in a shorter time without causing adhesion of carrier. When the toner concentration detected by the toner concentration sensor 200 falls to or below the lower limit of the tolerable toner concentration range, the controller 100 reduces the developing potential to V2, thereby weakening the developing electrical field generated in the developing range from the developing electrical field for image formation. With this control, even when the toner concentration in the developing device falls below the lower limit of the tolerable toner concentration range, the occurrence of adhesion of carrier is inhibited.

While the forced toner consumption is continued, when the toner concentration detected by the toner concentration sensor 200 falls to or smaller than the prescribed toner concentration, which is smaller than the lower limit of the tolerable toner concentration range (Yes at S15), the controller 100 completes the forced toner consumption at S16, without executing subsequent consuming actions. At S17, the controller 100 starts the post-consumption toner supply operation. With this operation, the toner concentration in the developing device 8 gradually increases. At S18, when the toner concentration detected by the toner concentration sensor 200 is equal to or greater than the lower limit of the tolerable toner concentration range (Yes at S18), at S19, the controller 100 increases the developing bias in absolute value to increase the developing potential. Additionally, the controller 100 increases the charging bias in absolute value. When the toner concentration detected by the toner concentration sensor 200 becomes equal to or greater than the target toner concentration (Yes at S20), the controller 100 completes the post-consumption toner supply operation at S21.

(Variation 2)

Next, descriptions are given below of Variation 2 of the forced toner consumption and the post-consumption toner supply operation described above.

Figure 8:
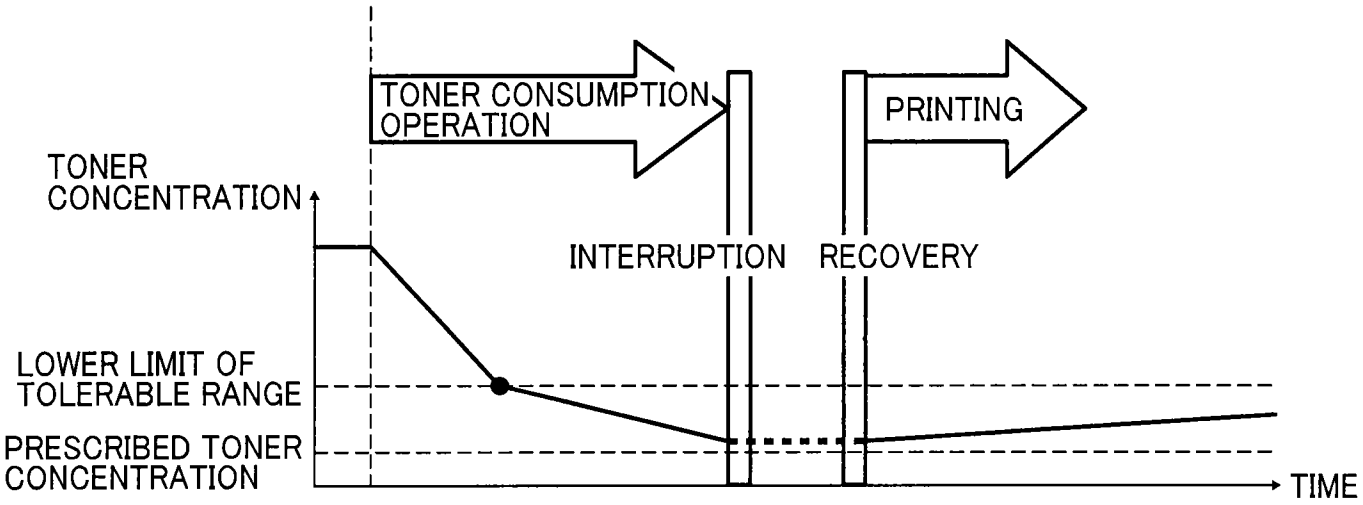
FIG. 8 is a schematic chart illustrating changes in toner concentration in a case where the forced toner consumption is interrupted, after which image formation is started with the toner concentration at the time of interruption.

In Variation 1 described above, while the forced toner consumption is executed, there is a period during which the toner concentration falls below the lower limit of the tolerable toner concentration range. There is the possibility that, in such a period, the forced toner consumption is interrupted as illustrated in FIG. 8, due to erroneous operation of users or malfunction of the apparatus. In this case, when the apparatus recovers from the interruption and starts image formation with the toner concentration at the time of interruption, the toner concentration is lower than the tolerable toner concentration range as illustrated in FIG. 8. In this case, the possibility of the occurrence of adhesion of carrier is particularly high during the image formation after the interruption. In view of the foregoing, such inconveniences are inhibited as follows in Variation 2.

Figure 9:
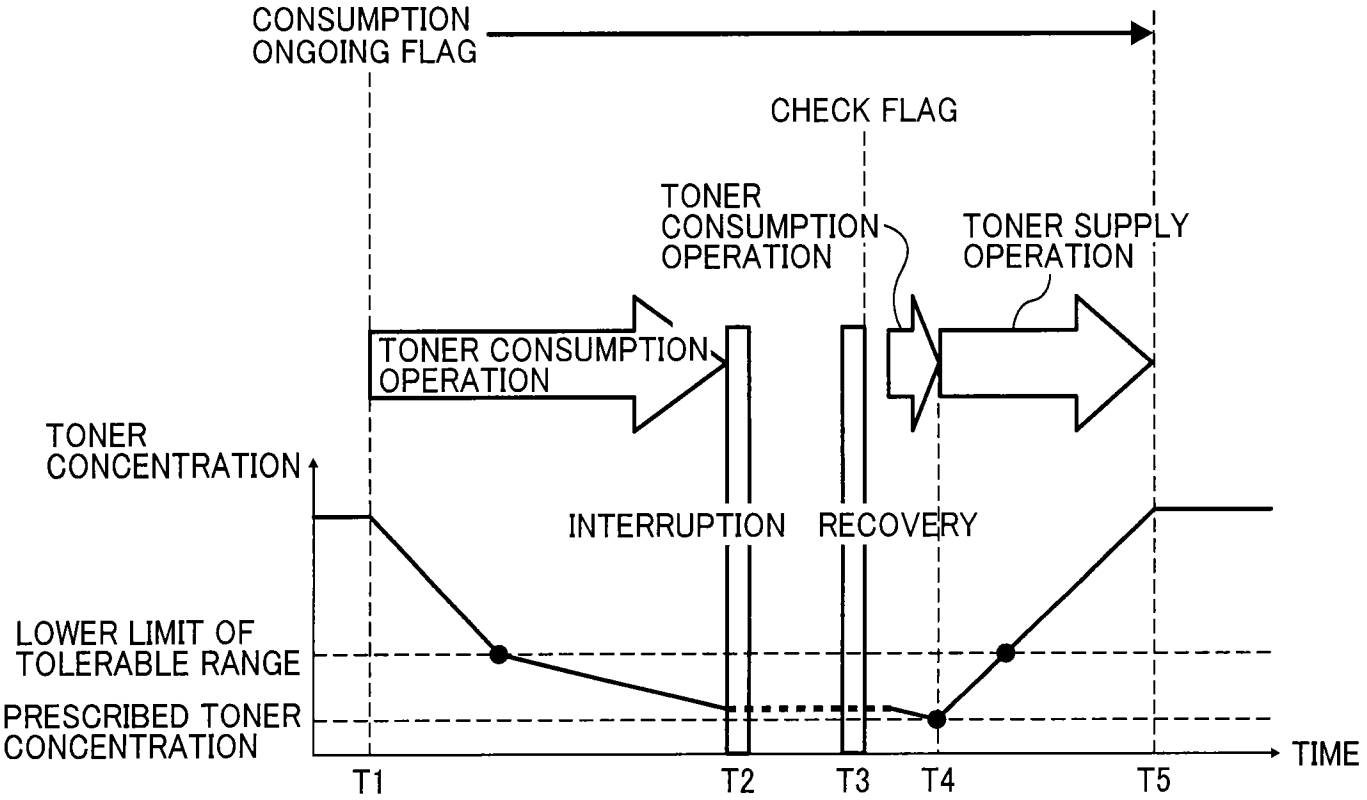
FIG. 9 is a schematic chart illustrating changes in toner concentration in developer during forced toner consumption and a subsequent toner supply operation according to Variation 2.

FIG. 9 is a schematic chart illustrating changes in toner concentration in developer during the forced toner consumption and the post-consumption toner supply operation according to Variation 2.

In Variation 2, a basic flow of the forced toner consumption and the post-consumption toner supply operation is similar to that according to Variation 1. Variation 2 is different in that, when there is the predetermined forced toner consumption timing at T1 in FIG. 9, the controller 100 sets a consumption ongoing flag, indicating that the forced toner consumption is ongoing, in a nonvolatile memory, such as the hard disk 108, capable of storing data even when the apparatus is not energized.

Specifically, the controller 100 sets the value of the consumption ongoing flag in the nonvolatile memory to "1", for example. By contrast, in the post-consumption toner supply operation, when the toner concentration detected by the toner concentration sensor 200 is increased to or greater than the target toner concentration (Yes at S20), the controller 100 cancels the consumption ongoing flag in the nonvolatile memory. For example, the controller 100 sets the value of the consumption ongoing flag in the nonvolatile memory to "0". With this control, in a period from when the forced toner consumption starts (T1 in FIG. 9) until the post-consumption toner supply operation is completed (T5), the consumption ongoing flag is set (i.e., active) in the nonvolatile memory.

For example, it is assumed that power supply is stopped at T2 in FIG. 9, and the forced toner consumption is interrupted midway. In Variation 2, at T3 at which the image forming apparatus 1 recovers from the interruption, the controller 100 initially checks the status of the consumption ongoing flag in the nonvolatile memory. When the consumption ongoing flag is active, the controller 100 determines that the predetermined forced toner consumption timing has arrived (Yes at S11) and starts (or resumes) the forced toner consumption as well as the post-consumption toner supply operation (from S12 to S21), similar to Variation 1 described above. Specifically, when the toner concentration falls to or below the prescribed toner concentration at T4, the controller 100 completes the forced toner consumption and starts the post-consumption toner supply operation.

By contrast, when the consumption ongoing flag is not active, the controller 100 starts image formation according to instructions, without executing the forced toner consumption and the post-consumption toner supply operation.

According to Variation 2, in the case where the forced consumption is interrupted due to some causes in a period in which the toner concentration is below the lower limit of the tolerable toner concentration range, the forced toner consumption and the post-consumption toner supply operation are executed at the recovery from the interruption. Accordingly, at the time of image formation after the recovery, the toner concentration is increased to the target toner concentration. Accordingly, this control operation can inhibit adhesion of carrier during the image formation.

Additionally, there is a risk that image quality degradation, such as image density reduction, is caused because of insufficient toner concentration if the interruption occurs in a period during which the toner concentration is lower than the target toner concentration, even if the toner concentration is not lower than the lower limit of the tolerable toner concentration range. As long as the interruption occurs while the forced toner consumption is executed, the control operation according to Variation 2 can inhibits, during the image formation after the recovery, image quality degradation, such as image density reduction, caused by insufficient toner concentration since the forced toner consumption and the post-consumption toner supply operation are executed at the recovery from the interruption.

It is to be noted that, although the consumption ongoing flag is stored in the nonvolatile considering the possibility that the forced toner consumption is interrupted by power shutdown, the consumption ongoing flag can be stored in a volatile memory when such interruption is not considered.

(Variation 3)

Next, descriptions are given below of Variation 3 of the forced toner consumption and the post-consumption toner supply operation described above.

In Variation 2 described above, in the case where the interruption occurs during the post-consumption toner supply operation, the forced toner consumption is executed again at the recovery from the interruption, and it is possible that an excessive amount of toner is forcibly consumed. In view of the foregoing, such inconveniences are inhibited as follows in Variation 3.

Figure 10:
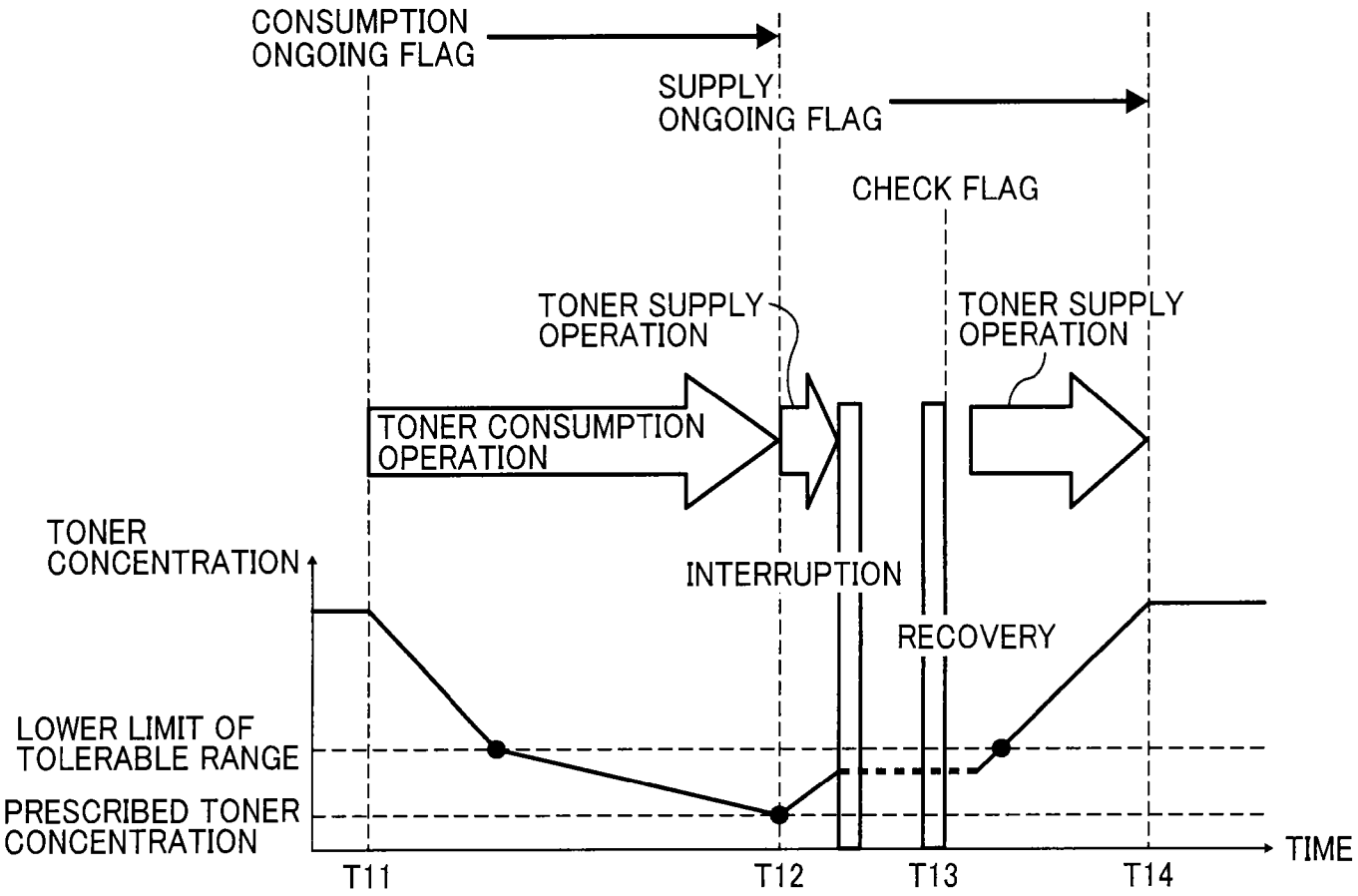
FIG. 10 is a schematic chart illustrating changes in toner concentration in developer during forced toner consumption and a subsequent toner supply operation according to Variation 3.

FIG. 10 is a schematic chart illustrating changes in toner concentration in developer during the forced toner consumption and the post-consumption toner supply operation according to Variation 3.

In Variation 3, a basic flow of the forced toner consumption and the post-consumption toner supply operation is similar to that according to Variation 2. Although, in Variation 2, the flag is not distinguished between the forced toner consumption and the post-consumption toner supply operation, in Variation 3, separate flags are used for the forced toner consumption and the post-consumption toner supply operation.

Specifically, in Variation 3, at T11 in FIG. 10, the predetermined forced toner consumption timing arrives (Yes at S11), and the controller 100 sets the consumption ongoing flag in the nonvolatile memory. For example, the controller 100 sets the value of the consumption ongoing flag in the nonvolatile memory to "1". By contrast, the toner concentration detected by the toner concentration sensor 200 falls to or below the prescribed toner concentration (at T12 in FIG. 10, Yes at S15 in FIG. 7), the controller 100 cancels the consumption ongoing flag in the nonvolatile memory. Simultaneously, in the nonvolatile memory, the controller 100 sets a supply ongoing flag, which indicates that the post-consumption toner supply operation is ongoing. For example, the controller 100 sets the value of the consumption ongoing flag in the nonvolatile memory to "0" and sets the supply ongoing flag to "1".

Subsequently, in the post-consumption toner supply operation, when the toner concentration detected by the toner concentration sensor 200 reaches or exceeds the target toner concentration (Yes at S20 in FIG. 7, at T14 in FIG. 10), the controller 100 cancels the supply ongoing flag in the nonvolatile memory. The controller 100 sets the value of the supply ongoing flag in the nonvolatile memory to "0", for example. With this control operation, the consumption ongoing flag is made active during the forced toner consumption and the supply ongoing flag is made active during the post-consumption toner supply operation.

In Variation 3, in a case where either the forced toner consumption or the post-consumption toner supply operation is interrupted, at the time of recovery from the interruption, the controller 100 checks the status of the consumption ongoing flag and that of the supply ongoing flag in the nonvolatile memory. Recognizing that the consumption ongoing flag is active, the controller 100 determines that the predetermined forced toner consumption timing has arrived (Yes at S11) and stars (or resumes) the forced toner consumption and the post-consumption toner supply operation (steps S12 through S21).

In the case illustrated in FIG. 10, at T13, the controller 100 checks the status of the consumption ongoing flag and that of the supply ongoing flag and recognizes that the supply ongoing flag is active. Then, the controller 100 does not execute the forced toner consumption but starts the post-consumption toner supply operation (steps S17 through S21). By contrast, when neither of the consumption ongoing flag and the supply ongoing flag are active, the controller 100 starts image formation according to instructions, without executing the forced toner consumption and the post-consumption toner supply operation.

In Variation 3 described above, in the case where the interruption occurs during the post-consumption toner supply operation subsequent to the forced toner consumption, at the recovery from the interruption, the forced toner consumption is not executed, and the post-consumption toner supply operation is executed. Accordingly, unnecessary executing of forced toner consumption is avoided.

It is to be noted that the description above is made using, as an example, an image forming apparatus including five photoconductors and employing an intermediate transfer method. However, the aspects of this specification are adaptable to tandem-type image forming apparatuses employing a direct transfer method. In the direct transfer method, respective toner images are transferred from multiple photoconductors and superimposed one on another on a sheet (i.e., a recording medium) carried on a conveyor belt serving as a conveyor. That is, in the image forming apparatus 1 illustrated in FIG. 1, the intermediate transfer belt 16 serves as the conveyor disposed facing the latent image bearer to transport either the toner image transferred from the latent image bearer or the recording medium.

The configurations described above are just examples, and each of the following aspects of this specification attains a specific effect.

Aspect A

An image forming apparatus includes at least one latent image bearer such as the photoconductors 5T, 5Y, 5M, 5C, and 5K; at least one developing device (such as the developing devices 8T, 8Y, 8M, 8C, and 8K) that contains developer including toner and carrier, develops a latent image on the latent image bearer into a toner image, and includes a developer bearer (such as the developing roller 8B) to bear the developer and supply the developer to a developing range facing the latent image bearer; a development voltage source (such as the power source 141) to apply a development voltage to the developer bearer to form a developing electrical field in the developing range to cause the toner to adhere to the latent image; and a toner concentration detector (such as the toner concentration sensor 200) to detect a concentration of toner in the developer in the developing device; a toner supply device (such as the toner supply device 4) to supply toner to the casing of the developing device; a transfer device (such as the transfer unit 15) to transfer the toner image, which is formed by the developing device developing the latent image with toner, onto a recording medium (such as the recording sheet S); and a controller (such as the controller 100) to cause, based on a detection result generated by the toner concentration sensor 200, the toner supply device to keep a toner concentration in the developer in the developing device at a target toner concentration during image formation and to execute forced toner consumption in which the developing device supplies the toner in the developing device to the latent image bearer to forcibly consume the toner, at a predetermined forced toner consumption timing. The controller starts the forced toner consumption while inhibiting the toner supply device from supplying toner and completes the forced toner consumption when the detection result generated by the toner concentration detector indicates that the toner concentration in developer in the developing device falls to a prescribed toner density lower than the target toner concentration. Then, the controller causes the toner supply device to execute a post-consumption toner supply operation to supply toner to the developing device.

With this aspect, since the forced toner consumption is executed in a state in which the toner supply by the toner supply device is stopped, degraded toner is efficiently consumed compared with the configuration to execute the forced toner consumption while supplying toner. Additionally, in this aspect, since the forced consumption is executed while stopping toner supply, the toner concentration (e.g., percentage of toner) in developer in the casing of the developing device decreases gradually. Since an extremely low toner concentration increases the possibility of adhesion of carrier, in this aspect, the controller stops the forced toner consumption when the toner concentration in developer in the casing of the developing device falls to or below the prescribed toner concentration. Accordingly, by setting the prescribed toner concentration properly, the controller inhibits the toner concentration from decreasing to a degree to cause adhesion of carrier. Accordingly, in this aspect, degraded toner in the developing device can be efficiently consumed while adhesion of carrier is inhibited.

Aspect B

In Aspect A, in the post-consumption toner supply operation, the controller causes the toner supply device to keep the toner concentration in developer in the developing device at the target toner concentration based on the detection result generated by the toner concentration detector.

According to this aspect, with the post-consumption toner supply operation, the toner concentration in developer in the developing device is recovered to the target toner concentration, and the image forming apparatus can move over to image formation.

Aspect C

In Aspect A or B, the controller changes the target toner concentration within the predetermined tolerable range, and the prescribed toner concentration is set to a lower limit of the predetermined tolerable range.

The lower limit of the tolerable toner concentration range, within which the target toner concentration is adjustable, is such a range that, if the toner concentration is below that range, there is the occurrence of inconveniences (such as adhesion of carrier) unsolvable by changing other image formation parameters or the like. According to this aspect, the degraded toner in the developing device is efficiently consumed in the forced toner consumption without causing such inconveniences (e.g., adhesion of carrier) that are insolvable by changing other image formation parameters.

Aspect D

In Aspect A or B, the controller changes the target toner concentration within the predetermined tolerable range, and the prescribed toner concentration is lower than the predetermined tolerable range, and after the toner concentration in developer in the developing device falls to or below the lower limit, the controller executes the forced toner consumption in a state in which a strength of the developing electrical field is smaller than a strength during image formation.

According to this Aspect, as described above in Variation 1, the forced toner consumption is continued until the toner concentration in developer in the casing of the developing device falls below the lower limit of the tolerable toner concentration range. Accordingly, a greater amount of toner is discharged (consumed) from the developing device. The risk of adhesion of carrier, however, increases when the toner concentration in the developing device is below the lower limit of the tolerable toner concentration range. In this aspect, after the toner concentration in developer in the developing device reaches (falls), at least, to the lower limit, the controller executes the forced toner consumption in the state in which the developing electrical field is smaller in strength than the developing electrical field during image formation. Accordingly, even when the toner concentration in the casing of the developing device falls below the lower limit of the tolerable toner concentration range, the occurrence of adhesion of carrier is inhibited.

Aspect E

In Aspect D, the controller executes the forced toner consumption in a state in which the strength of the developing electrical field is equal to or greater from than the strength during image formation until the toner concentration in developer in the developing device falls to a threshold, which is equal to or greater than the lower limit, and after the toner concentration in developer in the developing device falls to the threshold, the controller executes the forced toner consumption in a state in which the developing electrical field is weaker than the developing electrical field during image formation.

According to this aspect, the toner in the developing device can be consumed in a period until the toner concentration in developer in the casing of the developing device falls to the threshold, at which the risk of adhesion of carrier is small. Therefore, the duration of entire forced toner consumption operation can be shortened.

Aspect F

According to any one of Aspects A through E, the image forming apparatus includes three or more latent image bearers and forms toner images by developing the latent image bearers into toner images with respective toners in developers contained in different developing devices and transfers the toner images from the latent image bearers onto either an intermediate transfer member or a recording media sheet carried on a conveyor in a superimposed manner. The image forming apparatus further includes a cleaning device (such as the belt cleaner 25) to remove a substance adhering to the intermediate transfer member or the conveyor, and in the forced toner consumption, the controller causes the transfer device to transfer the toner adhering to the at least three latent image bearers to partly overlap on either the conveyor or the recording medium carried on the conveyor.

According to this aspect, as described above, the duration of the forced toner consumption can be reduced while inhibiting the occurrence of defective cleaning by the cleaning device.

Aspect G

In any one of Aspects A through F, the image forming apparatus further includes an operation accepting unit (such as the control panel 60) to accept an operation from a user, and when the operation accepting unit accepts a predetermined instruction, such as an operation made by a user, the controller considers acceptance of the predetermined instruction as the forced toner consumption timing and starts the forced toner consumption.

According to this aspect, the user or operator operating the operation accepting unit can execute the forced toner consumption at a desirable point of time for he or her.

Aspect H

According to any one of Aspects A through G, the image forming apparatus includes multiple latent image bearers and forms toner images by developing the latent image bearers into toner images with respective toners in developers contained in different developing devices and transfers the toner images from the latent image bearers onto either an intermediate transfer member or a recording media sheet carried on a conveyor in a superimposed manner, and the controller has a control operation mode to execute the forced toner consumption in a part of the multiple developing devices.

According to this aspect, the forced toner consumption can be executed only in the developing device that requires the forced toner consumption, and thus the duration of the forced toner consumption can be reduced.

Aspect I

In any one of Aspects A through H, the image forming apparatus further includes a memory device such as the nonvolatile memory or the HDD 109 to store a consumption ongoing data indicating that the forced toner consumption is ongoing (such as the consumption ongoing flag set to "1", the consumption ongoing flag set to "1", or both). The controller stores the consumption ongoing data (e.g., setting the consumption ongoing flag, the consumption ongoing flag, or both to "1") in the memory device when the predetermined forced toner consumption timing arrives, and the controller deletes the consumption ongoing data (e.g., setting the consumption ongoing flag, the consumption ongoing flag, or both to "0") from the memory device when the forced toner consumption completes. When either the forced toner consumption or the post-consumption toner supply operation is interrupted while the memory device keeps the consumption ongoing data, the controller executes the forced toner consumption and the post-consumption toner supply operation before starting image formation.

According to this aspect, in the case where the forced toner consumption or the post-consumption toner supply operation is interrupted, as described above in Variation 2, after the interruption, execution of image formation in a state in which the toner concentration is low can be avoided. Therefore, even if such interruption occurs, this aspect inhibits inconveniences such as adhesion of carrier and degradation in image quality resulting from image formation in the state in which the toner concentration.

Aspect J

In any one of Aspects A through I, the image forming apparatus further includes a memory device such as the nonvolatile memory to store a toner supply ongoing data indicating that the post-consumption toner supply operation is ongoing (such as the supply ongoing flag set to "1"). The controller stores the toner supply ongoing data (e.g., setting the supply ongoing flag to "1") in the memory device when the predetermined forced toner consumption timing arrives and the forced toner consumption completes, and the controller deletes the toner supply ongoing data (e.g., setting the supply ongoing flag to "0") from the memory device when the post-consumption toner supply operation completes. When the post-consumption toner supply operation is interrupted while the memory device keeps the consumption ongoing data, the controller executes the post-consumption toner supply operation, without executing the forced toner consumption, before starting image formation after the interruption.

According to this aspect, in the case where the post-consumption toner supply operation is interrupted, as described above in Variation 3, after the interruption, execution of image formation in a state in which the toner concentration is low can be avoided. Therefore, even if such interruption occurs, this aspect inhibits inconveniences such as degradation in image quality resulting from image formation in the state in which the toner concentration is not yet increased sufficiently. Additionally, this aspect can avoid the event where the forced toner consumption is executed again, thereby forcibly consuming toner unnecessarily.

It is to be noted that, in this disclosure, the term "sheet" used herein is not limited to a sheet of paper and includes anything such as OHP (overhead projector) sheet, cloth sheet, glass sheet, leather sheet, metal sheet, plastic sheet, wood sheet, ceramic sheet, or substrate to which toner or ink can adhere.

In other words, the term "sheet" is used as a generic term including a recording medium, a recorded medium, a recording sheet, and a recording sheet of paper.

The steps in the above-described flowchart may be executed in an order different from that in the flowchart.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

at least one latent image bearer;

at least one developing device to contain developer including toner and carrier, each of the at least one developing device including:

a developer bearer to supply the developer to a developing range facing the at least one latent image bearer, a development voltage source to apply a development voltage to the developer bearer to form a developing electrical field in the developing range to cause the toner to adhere to the at least one latent image bearer, thereby forming a toner image, and a toner concentration detector to detect a concentration of toner in the developer in the at least one developing device;

a toner supply device to supply the toner to the at least one developing device;

a transfer device to transfer the toner image onto a recording medium;

a controller to cause, based on a detected toner concentration detected by the toner concentration detector, the toner supply device to keep the concentration of toner in the developer in the at least one developing device at a target toner concentration during image formation, wherein the controller executes forced toner consumption in which the at least one developing device supplies the toner to the at least one latent image bearer to forcibly consume the toner at a predetermined forced toner consumption timing, the controller starts the forced toner consumption while inhibiting the toner supply device from supplying the toner and completes the forced toner consumption when the detected toner concentration falls to a prescribed toner concentration lower than the target toner concentration, and subsequent to the forced toner consumption, the controller executes a post-consumption toner supply operation in which the toner supply device supplies toner to the at least one developing device; and a memory device to store consumption ongoing data indicating that the forced toner consumption is ongoing, wherein the controller stores the consumption ongoing data in the memory device at the predetermined forced toner consumption timing, when the forced toner consumption completes, the controller deletes the consumption ongoing data from the memory device, and when either the forced toner consumption or the post-consumption toner supply operation is interrupted while the memory device stores the consumption ongoing data, the controller executes the forced toner consumption and the post-consumption toner supply operation before starting image formation.

2. The image forming apparatus according to claim 1, wherein, in the post-consumption toner supply operation, the controller causes the toner supply device to keep the concentration of toner in the developer in the at least one developing device at the target toner concentration based on the detected toner concentration.

3. The image forming apparatus according to claim 1, further comprising a second memory device to store a predetermined tolerable range of the target toner concentration, the predetermined tolerable range within which the controller changes the target toner concentration, wherein the prescribed toner concentration is a lower limit of the predetermined tolerable range.

4. The image forming apparatus according to claim 1, further comprising a second memory device to store a predetermined tolerable range of the target toner concentration, the predetermined tolerable range within which the controller changes the target toner concentration, wherein the prescribed toner concentration is lower than a lower limit of the predetermined tolerable range, and after the detected toner concentration falls to or below the lower limit, the controller reduces a developing electrical field strength and continues the forced toner consumption.

5. The image forming apparatus according to claim 4, wherein, after the detected toner concentration falls to or below the lower limit, the controller sets the developing electrical field strength lower than a developing electrical field strength for image formation.

6. The image forming apparatus according to claim 1, further comprising a second memory device to store a predetermined tolerable range of the target toner concentration, the predetermined tolerable range within which the controller changes the target toner concentration, wherein the prescribed toner concentration is lower than a lower limit the predetermined tolerable range, wherein, until the detected toner concentration falls to a threshold greater than the lower limit, the controller sets a developing electrical field strength equal to or greater than a strength for image formation and continues the forced toner consumption, and after the detected toner concentration falls to the threshold, the controller sets the developing electrical field strength lower than the developing electrical field strength for image formation and continues the forced toner consumption.

7. The image forming apparatus according to claim 1, wherein the image forming apparatus comprises:

at least three latent image bearers;

at least three developing devices to develop latent images on the at least three latent image bearers into toner images, respectively;

a conveyor disposed facing the at least three latent image bearers to transport either the toner images transferred from the at least three latent image bearers or the recording medium; and a cleaning device to remove a substance adhering to the conveyor, wherein the transfer device superimposes the toner images transferred from the at least three latent image bearers one on another on either the conveyor or the recording medium carried on the conveyor, and in the forced toner consumption, the controller causes the transfer device to transfer the toner adhering to a respective one of the at least three latent image bearers to partly overlap on either the conveyor or the recording medium carried on the conveyor.

8. The image forming apparatus according to claim 1, further comprising an operation accepting unit to accept an instruction, wherein, the controller determines acceptance of a predetermined instruction by the operation accepting unit as the predetermined forced toner consumption timing and starts the forced toner consumption.

9. The image forming apparatus according to claim 1, wherein the image forming apparatus comprises:

multiple latent image bearers; and multiple developing devices to develop latent images on the multiple latent image bearers into toner images, respectively; and a conveyor disposed facing the multiple latent image bearers to transport either the toner images transferred from the multiple latent image bearers or the recording medium, wherein the transfer device superimposes the toner images transferred from the multiple latent image bearers one on another on either the conveyor or the recording medium carried on the conveyor, and the controller has a control operation mode to execute the forced toner consumption in a part of the multiple developing devices.

10. An image forming apparatus comprising:

at least one latent image bearer;

at least one developing device to contain developer including toner and carrier, each of the at least one developing device including;

a developer bearer to supply the developer to a developing range facing the at least one latent image bearer, a development voltage source to apply a development voltage to the developer bearer to form a developing electrical field in the developing range to cause the toner to adhere to the at least one latent image bearer, thereby forming a toner image, and a toner concentration detector to detect a concentration of toner in the developer in the at least one developing device;

a toner supply device to supply the toner to the at least one developing device;

a transfer device to transfer the toner image onto a recording medium;

a controller to cause, based on a detected toner concentration detected by the toner concentration detector, the toner supply device to keep the concentration of toner in the developer in the at least one developing device at a target toner concentration during image formation, wherein the controller executes forced toner consumption in which the at least one developing device supplies the toner to the at least one latent image bearer to forcibly consume the toner at a predetermined forced toner consumption timing, the controller starts the forced toner consumption while inhibiting the toner supply device from supplying the toner and completes the forced toner consumption when the detected toner concentration falls to a prescribed toner concentration lower than the target toner concentration, and subsequent to the forced toner consumption, the controller executes a post-consumption toner supply operation in which the toner supply device supplies toner to the at least one developing device; and a memory device to store toner supply ongoing data indicating that the post-consumption toner supply operation is ongoing, wherein, when the predetermined forced toner consumption timing arrives and the forced toner consumption completes, the controller stores the toner supply ongoing data into the memory device, when the post-consumption toner supply operation completes, the controller deletes the toner supply ongoing data from the memory device, and when the post-consumption toner supply operation is interrupted while the memory device stores the toner supply ongoing data, the controller executes the post-consumption toner supply operation before starting image formation.

* * * * *